US007776204B2

(12) United States Patent
Hashimoto et al.

(10) Patent No.: US 7,776,204 B2
(45) Date of Patent: Aug. 17, 2010

(54) ION EXCHANGE MEMBRANE ELECTROLYTIC PROCESS

(75) Inventors: Terumi Hashimoto, Tamano (JP); Takamichi Kishi, Tamano (JP)

(73) Assignee: Chlorine Engineers Corp., Ltd., Tokyo (JP)

( * ) Notice: Subject to any disclaimer, the term of this patent is extended or adjusted under 35 U.S.C. 154(b) by 1457 days.

(21) Appl. No.: 11/156,593

(22) Filed: Jun. 21, 2005

(65) Prior Publication Data

US 2005/0279644 A1 Dec. 22, 2005

(30) Foreign Application Priority Data

Jun. 22, 2004 (JP) ..... 2004-183934

(51) Int. Cl.
*C25C 1/02* (2006.01)
*C25B 1/26* (2006.01)
*C25B 1/16* (2006.01)

(52) U.S. Cl. ..... 205/620; 204/263; 204/269

(58) Field of Classification Search ..... 205/620; 204/263, 269
See application file for complete search history.

(56) References Cited

U.S. PATENT DOCUMENTS 3,773,634 A 11/1973 Stacey et al.
4,253,923 A * 3/1981 Lynch et al. ..... 205/512
5,076,898 A * 12/1991 Nidola et al. ..... 205/620

FOREIGN PATENT DOCUMENTS

GB 1 480 538 7/1977

* cited by examiner

*Primary Examiner*—Harry D Wilkins, III
*Assistant Examiner*—Nicholas A. Smith
(74) *Attorney, Agent, or Firm*—Westerman, Hattori, Daniels & Adrian, LLP

(57) ABSTRACT

The invention provides an ion exchange membrane electrolytic process unlikely to undergo any current density drop even when brine having a concentration lower than usual. Electrolysis occurs while the concentration of an aqueous solution of an alkaline metal chloride in an anode chamber partitioned by a cation exchange membrane is set at 2.7 mol/l to 3.3 mol/l, and a gap is provided between the cation exchange membrane and the anode.

4 Claims, 1 Drawing Sheet

ION EXCHANGE MEMBRANE ELECTROLYTIC PROCESS

BACKGROUND OF THE INVENTION

The present invention relates generally to ion exchange membrane electrolytic process of brine such as solution of sodium chloride, and more specifically to an electrolytic process that is capable of electrolysis with high efficiency even when run at decreased brine concentrations.

For ion exchange membrane electrolysis of brine, each member of an ion exchange membrane electrolyzer is designed such that the electrolytic process can be run with high current efficiency while the electrical energy taken for electrolysis remains decreased, and the concentration, temperature, etc. of brine fed to the anode chamber of the ion exchange membrane electrolyzer are determined in such a way as to achieve efficient electrolysis.

As set forth typically in GB14080538, it has also been proposed to run an ion exchange membrane electrolyzer while the pressure of a cathode chamber is higher than that of an anode chamber to bring a cation exchange membrane in close contact with an anode, thereby efficiently running the electrolyzer at a decreased cell voltage. In a commercially available ion exchange membrane electrolyzer, it has been proposed to place a cation exchange membrane in close contact with an anode or reduce the gap between the cation exchange membrane and the anode and cathode down to substantially zero.

In an electrolytic system comprising ion exchange membrane electrolyzers, not only the ion exchange membrane electrolyzers but also associated setups including a brine feeder have capabilities of running the ion exchange electrolyzers with optimum efficiencies.

The need of increasing outputs may possibly be met by increasing the number of ion exchange membrane electrolyzers; in consideration of the capability of a brine feeder, however, it is commonly difficult to feed brine in the same concentration and flow rate as before to each ion exchange membrane electrolyzer from an existing brine feeder setup.

As the electrolytic system is run using the existing brine feeder setup while the amount of brine fed to each ion exchange membrane electrolyzer is decreased, there is a decrease in the concentration of dilute brine taken out of the ion exchange membrane, which otherwise causes more electroosmosis water to pass from an anode chamber into a cathode chamber, resulting in considerable decreases in current efficiency.

It has also been proposed to use an improved ion exchange electrolytic process wherein the concentration of brine fed to an anode chamber is adjusted to control the amount of electroosmosis water passing toward a cathode chamber side, thereby producing an aqueous sodium hydroxide solution having a desired concentration without substantially adding water to the cathode chamber (U.S. Pat. No. 3,773,634). However, the ensuing current efficiency is 41% to 80%, figures that are quite worthless for practical ion exchange membrane electrolysis.

In electrolysis, decreased current efficiency is a negative factor of vital significance; it is considered impossible to run an ion exchange membrane electrolyzer assembly while there is more electroosmosis water, and so never until now has it been proposed to increase the number of ion exchange membrane electrolyzers without enhancing the capability of the brine feeder setup.

A primary object of the invention is to provide an electrolytic process using an ion exchange membrane electrolyzer assembly, which enables efficient electrolysis without any current efficiency drop, even when decreases in the concentration of brine fed to the ion exchange membrane electrolyzer assembly cause more electroosmosis water to occur in an existing electrolytic arrangement wherein more ion exchange membrane electrolyzers are used without enhancing the capability of a brine feeder setup.

SUMMARY OF THE INVENTION

Specifically, the invention provides an ion exchange membrane electrolytic process, wherein electrolysis occurs while the concentration of an aqueous solution of an alkaline metal chloride in an anode chamber partitioned by a cation exchange membrane is set at 2.7 mol/l to 3.3 mol/l, and a gap is provided between the cation exchange membrane and the anode.

The invention also provides an ion exchange membrane electrolytic process, wherein the amount of electroosmosis water in association with alkaline metal ions migrating from the anode chamber to a cathode chamber is set at 5 mol/F or more.

Further, the invention provides an ion exchange membrane electrolytic process, wherein the gap between the anode and the cation exchange membrane is set at more than $X \cdot A+1.01$ mm and less than $X \cdot B$, where X is a current density ($kA/m^2$), A is 0.074 $mm \cdot m^2/kA$, and B is 0.725 $mm \cdot m^2/kA$.

DESCRIPTION OF THE PREFERRED EMBODIMENT

According to the ion exchange membrane electrolytic process of the invention, even when there is a decrease in the concentration of brine in the anode chamber of each ion exchange membrane electrolyzer due to the ion exchange membrane electrolyzers being provided in number more than the capability of a brine feeder setup, electrolysis can be carried out without incurring any large drop of current efficiency, because the cation exchange membrane and the anode are positioned at a predetermined gap. In other words, for the process of the invention, it is only needed to increase the number of ion exchange membrane electrolyzers without enhancing the capability of the brine feeder setup. It is thus practically possible to increase the outputs of chlorine and alkaline metal hydroxides by only increasing the number of ion exchange membrane electolyzers with no need of enhancing the capability of the brine feeder setup.

For electrolysis using an ion exchange membrane electrolzyer assembly, it has been considered essential since the early development of ion exchange membrane electrolyzers to carry out electrolysis with anodes in close contact with ion exchange membranes. According to the invention, however, it has now been found that as the ion exchange membrane electrolyzer assembly is run under similar conditions except that anodes are spaced away from ion exchange membranes, more electroosmosis water is produced, so that higher current efficiency is achievable when the concentration of brine in the anode chamber is decreased, although current efficiency is somewhat lower than could be obtained with an arrangement with ion exchange membranes in close contact with anodes.

When the anodes are spaced away from the ion exchange membranes as contemplated herein, it is possible to increase the outputs of chlorine, aqueous alkaline metal hydroxide solutions, etc. by only increasing the number of ion exchange membrane electrolyzers with no need of enhancing the capability of a brine feeder setup.

Figure 1:
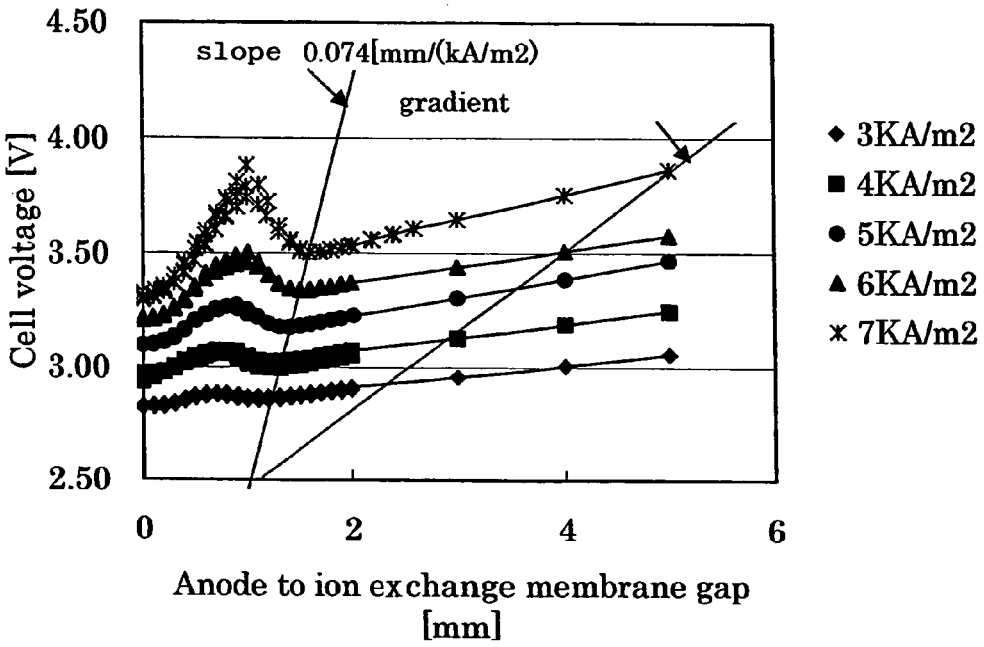
FIG. 1 is illustrative of the features of the invention, i.e., specific relationships between the anode-to-ion exchange membrane gap and the cell voltage.

FIG. 1 is illustrative of the features of the invention, i.e., the specific relationships between the anode-to-ion exchange membrane gap and the cell voltage.

Figure 2:
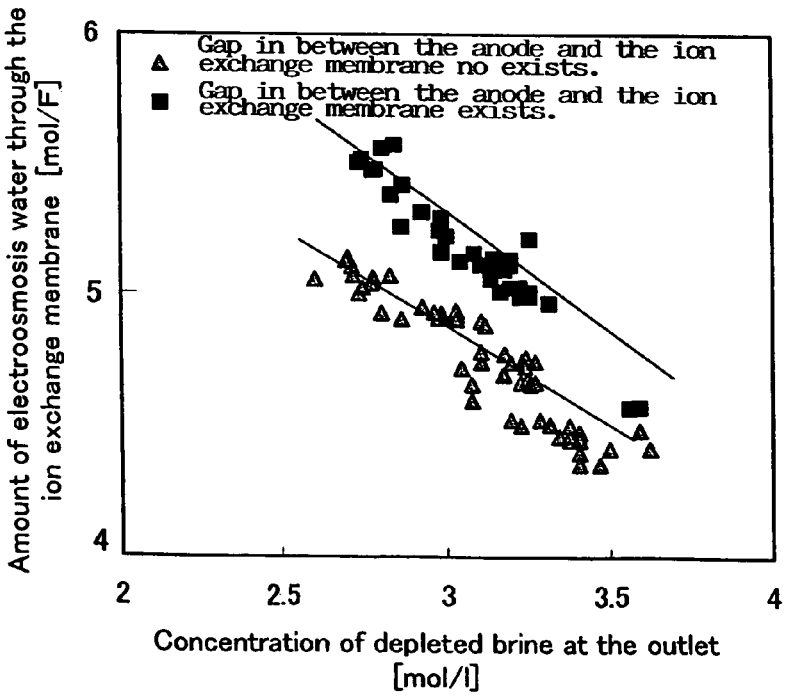
FIG. 2 is illustrative of the amount of electroosmosis water in the ion exchange membrane electrolytic process of the invention and the amount of electroosmosis water in an arrangement wherein an anode comes in close contact with an ion exchange membrane.

FIG. 2 is illustrative of what occurs when electrolysis is carried out at a varying anode-to-ion exchange membrane gap and a varying current density with the anode-to-ion exchange membrane gap as abscissa and calculated cell voltage as ordinate.

Electrolysis is carried out under the following conditions:

Ion Exchange Membrane: Flemion F8934 made by Asahi Glass Co., Ltd.

Anode: Electrode coated with a noble metal oxide made by Permelec Electrode Co., Ltd.

Cathode: Nickel electrode coated with an electrode catalyst

Anode Chamber: Loaded with an aqueous sodium chloride solution at a concentration of 195 g/l Cathode Chamber: Loaded with an aqueous sodium hydroxide solution at a concentration of 32 mass %

Electrolysis Temperature: 90° C.

Electrolysis was carried at current densities of 3 $kA/m^2$, 4 $kA/m^2$, 5 $kA/m^2$, 6 $kA/m^2$ and 7 $kA/m^2$ and a varying anode-to-ion exchange membrane gap to measure cell voltages.

As shown in FIG. 1, with a large anode-to-ion exchange membrane gap, the cell voltage becomes higher as compared with no gap. However, this cell voltage rise takes, not the form of any monotonous increase, the form of a curve that reaches a minimum point after going over a maximum value with respect to an increase in the electrode-to-electrode gap. At any current density, the minimum point appearing after the maximum value is indicative of an electrode-to-electrode gap of 1 mm or greater.

Generally in electrolyzers used for industrial electrolysis, some contrivance is needed for setting an electrode-to-ion exchange membrane gap at a desired value. In an ion exchange membrane electrolyzer comprising an electrode and an ion exchange membrane, each having a large area, however, a large electrode-to-ion exchange membrane gap is preferable to a small one. In other words, that a minimum value appears across an cell voltage at an anode-to-ion exchange membrane gap of 1 mm or greater is favorable for industrial ion exchange membrane electrolyzers.

Referring again to FIG. 1, given

X: a current density ($kA/m^2$), and

Y is an anode-to-cation exchange membrane gap (mm), a straight line of connecting minimum values appearing after maximum values at the respective current densities has a relation of $Y=A\cdot X+1.01$ (equation 1).

Where X is a current density ($kA/m^2$), and coefficient A is 0.074 $mm\cdot m^2/kA$.

Therefore, the anode-to-cation exchange membrane gap Y should preferably be greater than represented by equation 1. However, since a large electrode-to-electrode gap leads to a large cell voltage rise, the gap Y should preferably be less than represented by $$Y=B\cdot X \quad \text{(equation 2)}$$

Where X is a current density ($kA/m^2$), and coefficient B is 0.725 $mm\cdot m^2/kA$.

FIG. 2 is illustrative of the amount of electroosmosis water in the ion exchange membrane electrolytic process of the invention and the amount of electroosmosis water in an arrangement with an anode in close contact with an ion exchange membrane.

In the ion exchange membrane electrolytic process of the invention, it has been found that electroosmosis water to the cathode chamber and the concentration of dilute brine at the outlet of the anode chamber are represented by the following equation 3 in the case of brine electrolysis. This relation is shown in FIG. 2.

$$Y=-a\cdot x+b \quad \text{equation 3}$$

Where a and b are each a coefficient having a positive value, x is the concentration of depleted brine (g/l), and y is ion exchange membrane electroosmosis water (mol/F).

However, it is noted that equation 3 holds good for the concentration of dilute brine in the range of 150 g/l to 220 g/l. With electrolysis occurring at the same current density with the same ion exchange membrane species, assume that the values of a and b in equation 3 are given by a0, b0 and an, bn in the cases where the anode is, and is not, in contact with the ion exchange membrane, respectively. Then, among a0, an, b0 and bn, there are relations of equations 4 and 5.

$$a0\approx an \quad \text{equation 4}$$

$$b0<bn \quad \text{equation 5}$$

As can be seen from equations 3, 4 and 5, at the same dilute brine concentration, more electroosmosis water is always produced when the anode is not in contact with the ion exchange membrane. For some unknown reasons, when the anode is not in contact with the ion exchange membrane, current efficiency becomes higher at a lower dilute brine concentration and in a state where much more electroosmosis water is produced, resulting in higher outputs with the amount of brine used cut back.

Preferably, the concentration of brine in the anode chamber should be in the range of 2.7 mol/l to 3.3 mol/l. At more than 3.3 mol/l and at less than 2.7 mol/l alike, current efficiency drops.

With the ion exchange membrane electrolytic process of the invention, more electroosmosis water passes from the anode chamber into the cathode chamber; the amount of that water is increased up to 5.0 mol/F or more. Consequently, the amount of brine fed to the anode chamber is reduced with respect to the unit amount of the ensuing sodium hydroxide.

While the ion exchange membrane electrolytic process of the invention has been described with reference to the specific embodiment where a hydrogen generation electrode is used as the cathode, it is understood that the invention is also preferably applied to an ion exchange membrane electrolytic process using as the cathode a gas diffusion electrode that is kept against any hydrogen generation reaction with oxygen, because electrolysis occurs while more electroosmosis water and higher current efficiency are maintained.

The present invention is now explained with reference to inventive, and comparative examples.

EXAMPLE 1

An anode (noble metal oxide coated electrode made by Permelec Electrode Ltd.) comprising an electrode catalyst coating formed on a titanium expanded metal substrate of 100×100 mm in size and a nickel electrode comprising an electrode catalyst coating layer formed on a nickel expanded metal substrate of 100×100 mm in size were oppositely positioned, and an ion exchange membrane (Flemion F8934 made by Asahi Glass Co., Ltd.) was interposed between the anode and the cathode to form an anode chamber and a cathode chamber.

The ion exchange membrane was spaced 1.5 mm away from the anode, and the gap between the ion exchange membrane and the cathode was set at 0 mm, i.e., they were in close contact.

Electrolysis was carried out with the concentration of brine in the anode set at 2.99 mol/l and the concentration of an aqueous sodium hydroxide solution in the cathode set at 32 mass % and at a current density of 4 kA/$m^2$ and a temperature of 90° C. As a result, it was found that the cell voltage was 3.01 V, the amount of electroosmosis water from the anode chamber to the cathode chamber was 5.2 mol/F, and current efficiency was 97.5%.

EXAMPLE 2

With the exception that the concentration of brine in the anode was 2.73 mol/l, electrolysis was carried out under otherwise the same conditions as in Example 1. It was consequently found that the amount of electroosmosis water from the anode chamber to the cathode chamber was increased to 5.5 mol/F and current efficiency was 97.0%.

EXAMPLE 3

With the exception that the concentration of brine in the anode was 3.25 mol/l, electrolysis was carried out under otherwise the same conditions as in Example 1. It was consequently found that the amount of electroosmosis water from the anode chamber to the cathode chamber went down to 5.0 mol/F and current efficiency was 97.5%.

EXAMPLE 4

With the exception that the anode was spaced 2.1 mm away from the ion exchange membrane, electrolysis was carried out under otherwise the same conditions as in Example 1. It was consequently found that the cell voltage was 3.07 V.

COMPARATIVE EXAMPLE 1

With the exception that the anode was in close contact with the ion exchange membrane, electrolysis was carried out under otherwise the same conditions (including the concentration of brine in the anode chamber) as in Example 1. It was consequently found that the amount of electroosmosis water from the anode chamber to the cathode chamber was 4.8 mol/F and current efficiency was 96.5%.

COMPARATIVE EXAMPLE 2

With the exception that the anode was in close contact with the ion exchange membrane, electrolysis was carried out under otherwise the same conditions (including the concentration of brine in the anode chamber) as in Example 2. It was consequently found that the amount of electroosmosis water from the anode chamber to the cathode chamber was 5.0 mol/F and current efficiency was 95.5%.

COMPARATIVE EXAMPLE 3

With the exception that the anode was in close contact with the ion exchange membrane, electrolysis was carried out under otherwise the same conditions (including the concentration of brine in the anode chamber) as in Example 3. It was consequently found that the amount of electroosmosis water from the anode chamber to the cathode chamber was 4.5 mol/F and current efficiency was 97.0%.

COMPARATIVE EXAMPLE 4

With the exception that the concentration of brine in the anode was 2.56 mol/l with the anode in close contact with the ion exchange membrane, electrolysis was carried out under otherwise the same conditions as in Example 1. It was consequently found that the amount of electroosmosis water from the anode chamber to the cathode chamber was increased to 4.8 mol/F and current efficiency was 95.0%.

According to the ion exchange membrane electrolytic process of the invention, electrolysis is carried out with an electrolyzer assembly wherein an anode is spaced away from an ion exchange membrane, i.e., with no gap between them, whereby, even when there is a decrease in the concentration of brine fed to each ion exchange membrane electrolyzer, which is caused by the provision of ion exchange membrane electrolzyers exceeding the capability of a brine feeder setup, the ion exchange membrane electrolyzers can be run with higher rates of utilization of brine yet without suffering from any current efficiency drops.

What we claim is:

1. An ion exchange membrane electrolytic process, wherein electrolysis occurs while the concentration of an aqueous solution of an alkaline metal chloride in an anode chamber partitioned by a cation exchange membrane is set at 2.7 mol/l to 3.3 mol/l, and a gap is provided between the cation exchange membrane and the anode and the cation exchange membrane is in close contact with the cathode.

2. The ion exchange membrane electrolytic process according to claim 1, wherein the amount of electroosmosis water in association with alkaline metal ions migrating from the anode chamber to a cathode chamber is 5 mol/F or more.

3. The ion exchange membrane electrolytic process according to claim 1, wherein the gap between the anode and the cation exchange membrane is set at more than X·A+1.01 mm and less than X·B, where X is a current density (kA/$m^2$), A is 0.074 mm·$m^2$/kA, and B is 0.725 mm·$m^2$/kA.

4. The ion exchange membrane electrolytic process according to claim 2, wherein the gap between the anode and the cation exchange membrane is set at more than X·A +1.01 mm and less than X·B, where X is a current density (kA/$m^2$), A is 0.074 mm·$m^2$/kA, and B is 0.725 mm·$m^2$/kA.

* * * * *